United States Patent [19]

Waldman

[11] 3,948,006

[45] Apr. 6, 1976

[54] DIAMOND FACETING PLATFORM

[76] Inventor: Joseph Waldman, 899 Montgomery St., Brooklyn, N.Y. 11213

[22] Filed: Jan. 15, 1975

[21] Appl. No.: 541,334

[52] U.S. Cl. ..... 51/229

[51] Int. Cl.[2] ..... B24B 19/16

[58] Field of Search ..... 51/229; 308/65, DIG. 7, 308/DIG. 8

[56] References Cited

UNITED STATES PATENTS

| | | | |
|---|---|---|---|
| 1,284,008 | 11/1918 | White | 308/65 UX |
| 1,536,018 | 4/1925 | Kelley | 308/65 X |
| 2,431,907 | 12/1947 | Barna | 51/229 X |
| 2,449,156 | 9/1948 | Wiltig | 308/65 X |
| 3,056,709 | 10/1962 | Rising | 308/DIG. 7 UX |
| 3,815,289 | 6/1974 | Hoffman | 51/229 X |

*Primary Examiner*—Harold D. Whitehead
*Attorney, Agent, or Firm*—Friedman & Goodman

[57] ABSTRACT

An improved adjustable diamond faceting platform is described of the type adapted to be mounted on a tong and suitable for supporting a dop. The adjustable diamond faceting platform of the present invention includes a worm gear mounted on the platform. The worm gear has an axis of rotation and includes means for connecting a dop to the worm gear for common rotation about the axis. A worm is rotatably mounted on the platform proximate to the worm gear for meshingly engaging the latter and for rotating the same with corresponding rotation of the worm. The worm is mounted with clearance for limited transverse movements in directions towards and away from the worm gear. The worm is provided with smooth cylindrical shaft portions at each end disposed within the platform. Low friction sleeves are mounted on the shaft portions and adjustable bearing means, in the form of set screws, are mounted on the platform for engaging the sleeves and applying selective pressures to the latter in the direction of the worm gear. In this manner, suitable adjustment of the set screws compensate for tolerances and wear and provides positive engagement between the worm gear and the worm while the latter is permitted to rotate within the sleeves.

3 Claims, 6 Drawing Figures

DIAMOND FACETING PLATFORM

BACKGROUND OF THE INVENTION

This invention generally relates to diamond polishing and adjusting devices, and more particularly to an improvement in a diamond faceting platform which assures continued positive engagement between a dop supporting worm gear and a manually operable worm engaged with the worm gear.

Various diamond polishing and adjusting devices are known which support dops and are adapted to selectively alter the position of the dop for successive cutting and polishing of diamond facets. Many of these diamond polishing and adjusting devices, or diamond faceting platforms, include gear arrangements which facilitate changing of the angular positions of a dop or diamond. In one known arrangement, a worm gear is provided which is in the form of a dop receiver or dop mounting member, a cooperating worm being provided which is accessible and manually operable. The worm of the known device engages the worm gear and rotation of the worm results in corresponding rotation of the worm gear about an axis substantially normal to the axis of the worm. In order to facilitate rotation of the worm within the platform structure, and considering manufacturing tolerances and wear, the bore in which the worm is disposed generally has a diameter greater than that of the worm. Accordingly, the worm is disposed within the bore with clearance and is generally movable within the bore in transverse directions towards and away from the worm gear.

The above described play between the worm and the worm gear is undesirable since it does not result in positive engagement between the two members and thereby results in a backlash or positioning error when the direction of the worm is reversed. In order to enhance the positive engagement between the worm and the worm gear, it has been proposed to utilize a leaf spring which bears against the worm and biasses the latter in the direction of the worm gear. This solution does not, however, solve the problem entirely since the leaf springs which are utilized are normally effective only over limited distance ranges and sometimes do not provide the desired biassing action at all positions of the worm. This is particularly true as the leaf spring approaches its unstressed condition and thereby applies smaller and smaller forces to the worm. Also, when the leaf spring is maintained in a flexed condition for a long period of time, it tends to lose some of its resiliency as it sets or begins to assume the deformed condition due to fatigue. In either case, the user has very little control over the degree of biassing or positive engagement of the worm with the worm gear once the platform is assembled.

The present devices eliminates the above described disadvantage in the use of the leaf spring and replaces this biassing arrangement with a pair of set screws which act upon low friction sleeves in which smooth end or shaft portions of the worm are journalled. The set screws provides a great degree of control and adjustability of the position of the worm relative to the worm gear to thereby permit positive engagement between the two members independently of manufacturing tolerances and wear. With the present arrangement, because the set screws act upon the low friction sleeves and not upon the worm itself, the worm is permitted to fully rotate within the sleeves and thereby actuate the worm gear and the dop supported thereon.

SUMMARY OF THE INVENTION

It is an object of the present invention to provide a diamond faceting platform which does not have the above described disadvantages associated with prior art platforms.

It is another object of the present invention to provide a diamond faceting platform which is simple in construction and economical to manufacture.

It is still another object of the present invention to provide a diamond faceting platform which includes a worm and worm gear, and means for continuously assuring positive engagement between the worm and the worm gear.

It is yet another object of the present invention to provide a diamond faceting platform which provides positive engagement between a dop supporting worm gear and an actuating or adjusting worm irrespective of manufacturing tolerances and wear.

It is a further object of the present invention to provide an improvement in a diamond faceting platform which includes a dop supporting worm gear and an adjusting worm, and a pair of set screws which act upon low friction sleeves through which end or shaft portions of the worm are journalled.

In order to achieve the above objects, as well as others which will become apparent hereafter, the improvement of the present invention, in an adjustable diamond faceting platform adapted to be mounted on a tong and suitable for supporting a dop, comprises a worm gear mounted on the platform. Said worm gear has an axis of rotation and includes means for connecting a dop to said worm gear for common rotation about said axis. A worm is provided which is rotatably mounted on the platform proximate to said worm gear for meshingly engaging the latter and rotating the same with corresponding rotation of said worm. Said worm is mounted with clearance for limited transverse movement in directions towards and away from said worm gear. Adjustable bearing means are provided which are mounted on the platform for engaging said worm and applying selective pressures to the latter in the direction of said worm gear. In this manner, suitable adjustment of said bearing means compensates for tolerances and wear and provides positive engagement between said worm gear and said worm.

According to a presently preferred embodiment, said worm has smooth cylindrical shaft portions at each end thereof within a bore formed in the platform for containing the worm. Substantially rigid sleeves are provided on each shaft portion within the bore. Said bearing means comprises set screws engageable with said sleeves with advancement of the set screws in the direction of the worm gear. In this manner, the set screws can bear on and transversely move said worm within said bore towards said worm gear while permitting said worm to freely rotate about the axis thereof within said bore and said sleeves. Advantageously, said sleeves are made of a material having a low coefficient friction, such as Teflon, and are provided with smooth surfaces which are in contact with said shaft portions to minimize friction during rotation of said worm within the sleeves.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

DESCRIPTION OF THE PREFERRED EMBODIMENTS

Figure 1:
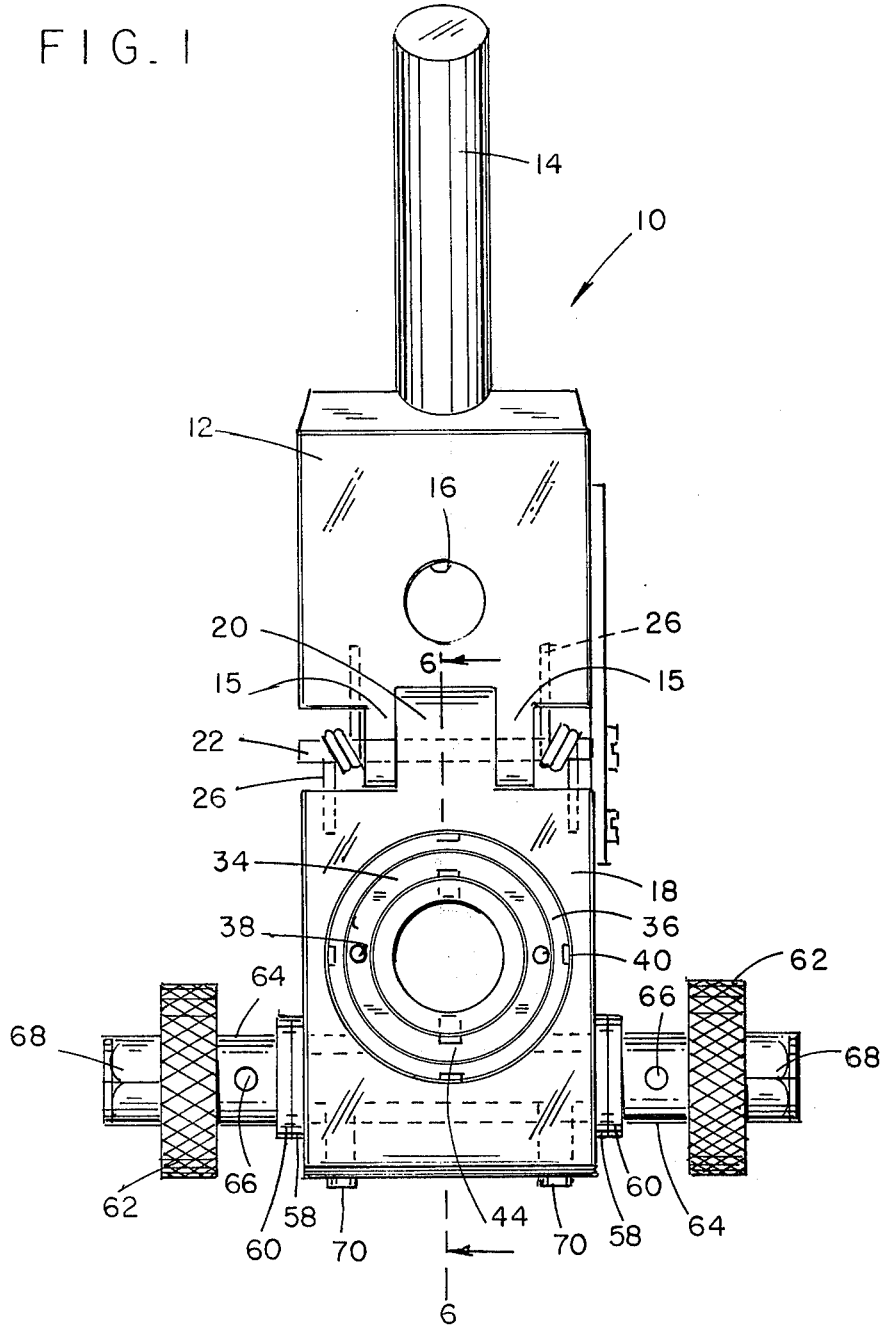
FIG. 1 is a top plan view of an improved diamond faceting platform in accordance with the present invention.

Referring in more detail to the drawings, wherein identical or similar parts are designated by the same reference numerals throughout, and first referring to FIGS. 1–4, the improved platform in accordance with the present invention is generally designated by the reference numeral 10. The platform 10 is of the type which is adapted to be mounted on a tong or diamond polishing arm and suitable for supporting a dop, as to be described hereafter.

The platform 10 includes a mounting plate 12 which can be made of any suitable material, such as stainless steel. At one end of the mounting plate 12 there is provided a stem or mounting post 14 which is receivable within a mating bore of a tong or arm. Suitable and conventional means may be provided on the tong for connecting the mounting post to the latter and for adjustably altering the orientation of the platform 10 about the axis of the mounting post 14.

Disposed at the opposite end of the mounting plate 12 there is provided a pair of spaced knuckles 15 forming a bifurcated or forked arrangement forming part of a hinge, as to be described hereafter. The mounting plate 12 is also provided with a threaded hole 16 whose function will be given in the description that follows.

An adjustable plate 18 is hingedly connected to the mounting plate 12 by means of a projection or knuckle 20 which mates with and is interposed between the bifurcated members 15. A hinge pin 22 extends through respective holes within the knuckles 15 and 20 to form a hinge and permit the plates 12 and 18 to pivot relative to each other about the hinge pin.

Figure 2:
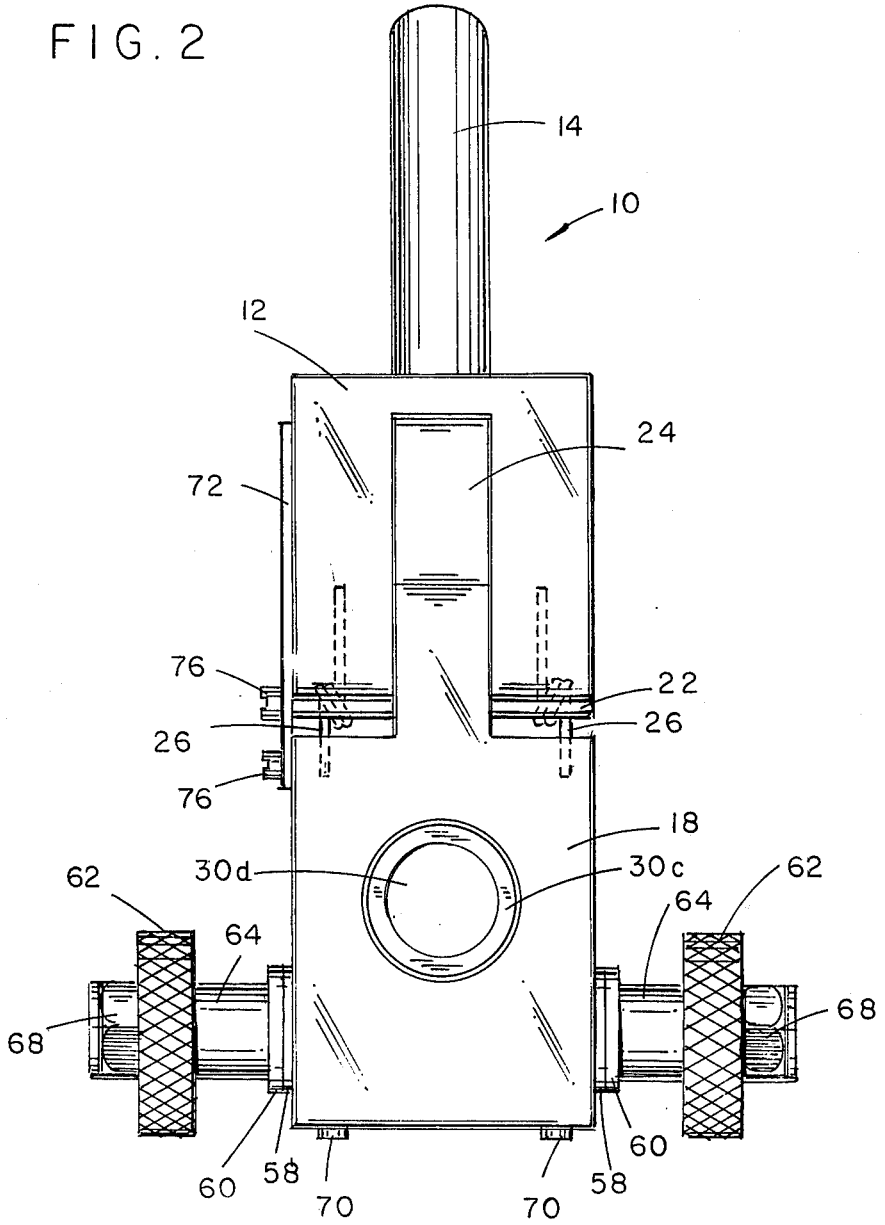
FIG. 2 is a bottom plan view of the platform shown in FIG. 1.
Figure 3:
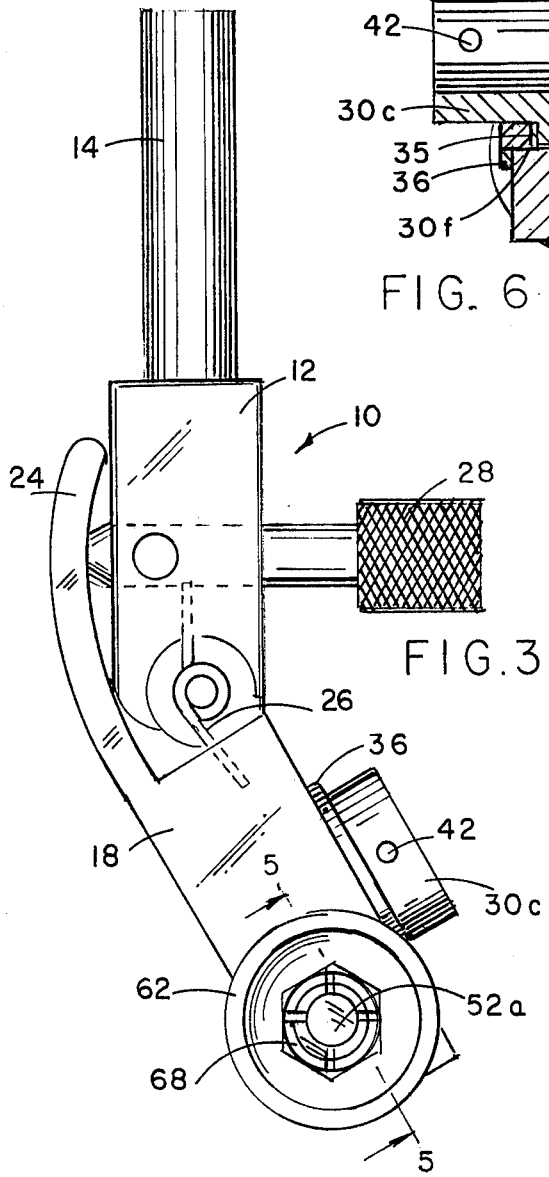
FIG. 3 is a right side elevational view of the platform shown in FIG. 1.
Figure 4:
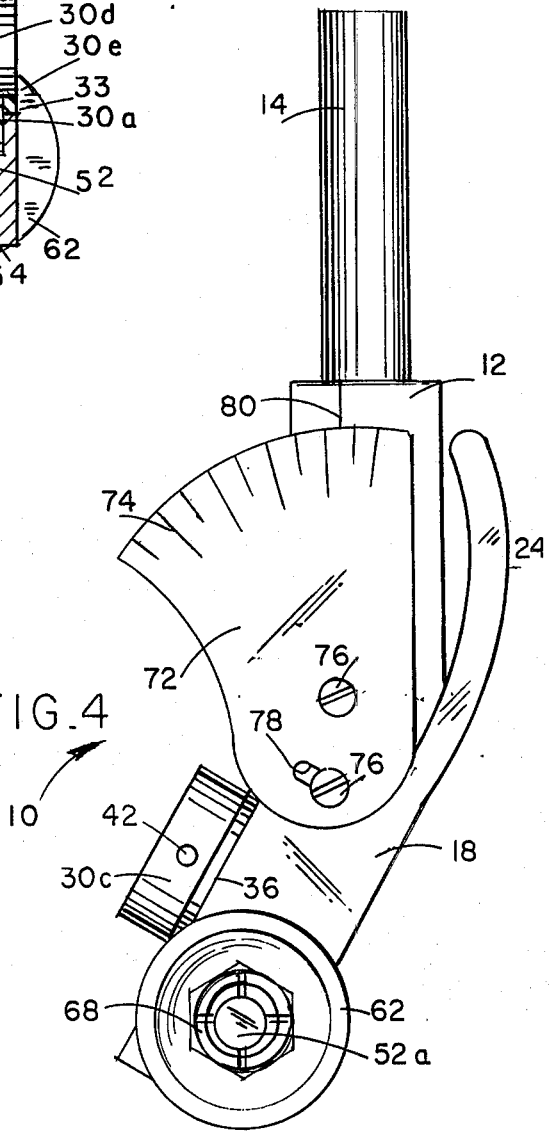
FIG. 4 is a left side elevational view of the platform shown in FIG. 1.

As can best be seen in FIGS. 2–4, a tongue or arcuate projecting finger 24 extends from the lower region of the knuckle or projection 20 and extends in the direction of the plate 12. The projecting finger 24 is arcuate, as shown, and gradually deflects or is bent towards the plate 12. A pair of helical springs 26 are provided about each end of the hinge pin 22, the springs having elongate ends which are disposed within holes (not shown) in the respective plates 12 and 18. The springs 26 are arranged to bias the adjustable plate 18 about the hinge pin 22 towards the positions shown in FIGS. 3 and 4, namely wherein the free end of the arcuate projecting finger 24 abuts against or is at the closest position to the mounting plate 12. In FIG. 3, a knurled set screw 28 shown in dashed outline which is receivable within the threaded hole 16 and engageable with the arcuate projecting finger 24 when the set screw 28 is sufficiently advanced in the direction of the finger. Clearly, adjustment of the set screw 28 permits the finger 24 to be urged away from the mounting plate 12 with attendant pivotal movement of the adjustable plate 18 relative to the mounting plate 12 about the hinge pin 22. Since the diamond-supporting dop is mounted on the adjustable plate 18, turning the set screw 28 similarly changes the orientation of the dop. As the set screw 28 is advanced, the engaging end of the set screw rides along the arcuate surface of the projecting finger 24 to provide the desired orientation changes or increments.

Figure 6:
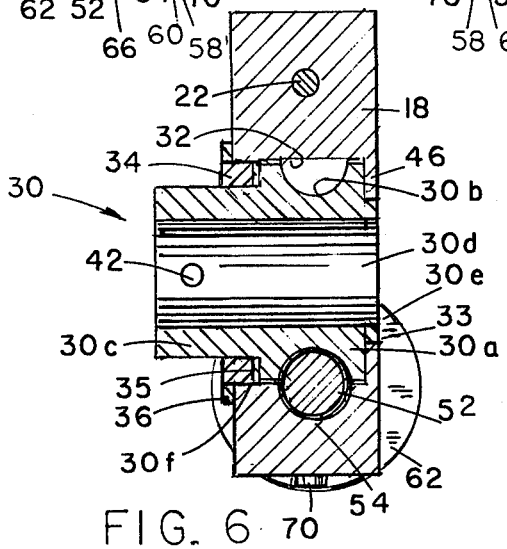
FIG. 6 is a cross sectional view of the platform shown in FIG. 1, taken along line 6—6.

Referring to FIG. 6, a dop receiving socket provided on the adjustable plate 18 is shown and generally designated by the reference numeral 30. The dop receiving socket or dop engaging member 30 includes a worm gear **30*a* provided with teeth 30*b* and generally received within a bore 32 having an axis substantially normal to the plane defined by the plate 18. While the worm gear 30*a* is disposed within the plate 18, a worm wheel extension 30*c* is provided which projects beyond or above the plate 18. An elongate bore 30*d* extends through the extension 30*c* and the worm gear 30*a*, the bore 30*d* being dimensioned to receive a complementary shaft portion or stem or other suitable connecting means for connecting a dop to the socket 30**.

An annular extension **30*e* is provided which projects from the worm gear 30*a* in a direction opposite to the direction in which the extension 30*c* projects. The annular extension 30*e* is received within a smaller diameter hole, in the plate 18, at one end of the bore 32 which is coaxial with the latter. The annular extension 30*e* extends through and is securely held within the smaller diameter hole 33 to limit the movement of the dop engaging member 30 within the bore 32**.

The height of the worm gear **30*a* is selected to provide a shoulder or bearing surface 30*f* disposed below the surface of the adjustable plate 18. The end of the bore 32 in the region of the shoulder 30*f* is threaded internally to receive the external threads of a collar 34. A low friction washer 35 is advantageously disposed between the collar 34 and the shoulder 30*f* before the collar 34 is tightened or advanced into the bore 32 to bear against the worm gear 30*a* and prevent the same from leaving the bore 32. The washer 35 promotes low frictional movement of the worm gear 30*a* relative to the collar 34 when the latter abuts the former in pressure relationship. Advantageously, a lock nut 36 is threadedly meshed about the exterior diameter of the collar 34. The lock nut 36 locks the position of the collar 34 and prevents the latter from disengaging from the plate 18**.

Referring to FIG. 1, the collar 34 may be provided with holes 38 and the lock nut 36 may be provided with notches 40 disposed about the circumference thereof. The holes 38 and notches 40 facilitate gripping and tightening the collar 34 and lock nut 36 respectively.

Provided in the cylindrical portion or worm wheel extension **30*c* is one or more threaded holes 42 suitable for receiving set screws 44, shown in FIG. 1, which are adapted to engage and fix the position of the mounting post of a dop. Clearly, rotation of the worm gear 30*a* about the axis of the elongate bore 30*d* causes the mounting post of a dop received therein to share common rotary movements of the worm gear 30*a***.

A washer 46 may be disposed at the lower end of the worm gear 30*a*, similar to the washer 35, for reducing the frictional forces between the worm gear 38 and the corresponding abutting portions of the plate 18. The washers 35 and 46 are advantageously made of a low friction material and provided with smooth surfaces. A material which has been found suitable for this purpose is Teflon.

As described above, the dop engaging member or dop receiving socket 30 is substantially fixed about its axis against transverse movements because of the engagement of the annular extension 30*e* with the hole 33 drilled at the lower end of the bore in the plate 18. The worm gear 30*a* is also maintained in position relative to its axis by means of the collar 34 which engages the cylindrical portion or extension 30*c*. Thus, while the worm gear 30*a* can rotate about the axis thereof, it is substantially fixed insofar as transverse movements to this axis are concerned.

Figure 5:
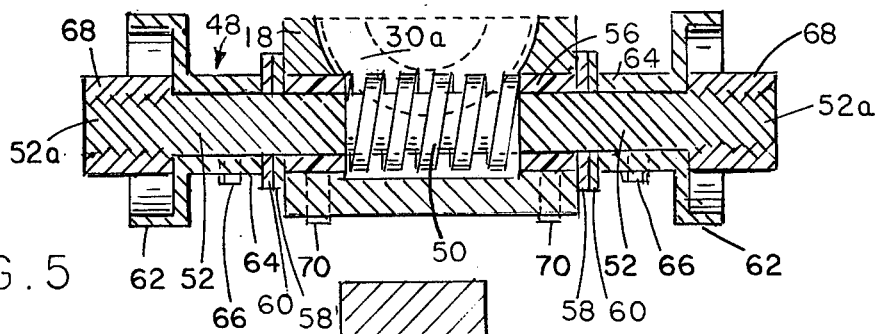
FIG. 5 is a cross sectional view of the platform shown in FIG. 3, taken along line 5—5.

Referring to FIG. 5, a worm arrangement 48 is shown including a worm 50 provided with threads meshingly engageable with the teeth 30*b* of the worm gear 30*a*. The threaded portion of the worm 50 is centrally disposed within the plate 18, with shaft or end portions 52 extending from the worm threaded portion axially to each end of the worm. As best shown in FIG. 6, the worm shaft 52 is disposed within a bore 54 of the plate 18 which communicates with and extends in a direction transverse to the direction of the bore 32. The bore 54 is provided with a diameter which is greater than the diameter of the worm 50 or shaft portion 52. This provides a clearance which permits limited transverse movements of the worm 50 in directions towards and away from the worm gear 30*a*. With extended use, the bore 54 may become further enlarged and the clearance becomes more pronounced.

Referring to FIG. 5, it is noted that the shaft or end portions 52 are cylindrical and smooth and not provided with threads. A portion of the shaft 52 is disposed within the plate 18 while a portion thereof extends or projects beyond. A bearing ring, tube or sleeve 56 is disposed about each shaft portion 52 within the plate 18 within which the respective shaft portion is journalled. The outer diameters of the sleeves 56 are substantially equal to the outer diameters of the worm teeth. Accordingly, the sleeves 56 experience the same clearances within the bore 54 as does the threaded portion of the worm 50.

Outside of the plate 18, there is provided, on each shaft portion 52, a metal washer 58 and a Teflon washer 60. The metal washers 58 are provided to protect the Teflon washers 60 from becoming damaged by being cut with extended use by the edges at the ends of the bore 54. Thus, the metal washers 58 cover the bore edges.

A knurled knob 62 is mounted on each shaft portion 52, each knob 62 having a collar 64 through which set screws are disposed for advancement in the direction of the shaft portions 52. In this manner, the knurled knobs 62 can be fixed on the shaft portions 52 in the desired positions, namely in abutment with the Teflon washers 60. To further assure the fixed positions of the knurled knobs 62 on the shaft portions 52, locking nuts 68 may be provided on threaded end portions 52*a* of the shaft portions 52.

An important feature of the present invention is the provision of set screws 70 which are mounted on the plate 18 for advancement in the directions of the worm arrangement 48. More specifically, the set screws 70 are adapted to abut against and engage the rings or sleeves 56. As suggested above, the rings or sleeves 56 are made of a low friction material, such as Teflon or Nylon, and are provided with smooth inner surfaces. Advantageously, the sleeves 56 are essentially rigid to be capable of withstanding the forces applied by the set screws 70 without being substantially deformed.

With the worm arrangement 48 disposed between the worm gear 30*a* and the set screws 70, it should be clear that advancement of the set screws makes it possible to transversely move the worm 50 within the bore 54 in the direction of the worm gear 30*a* while permitting the worm to freely rotate about the axis thereof within the bore 54 and the sleeves 56.

As suggested in the Background of the Invention, the prior art devices have not provided sleeves such as sleeves 56 and set screws 70. The prior art has merely utilized leaf springs which have directly abutted against the equivalent of shaft portions 52 for the purpose of biassing the latter in the direction of the worm gear. However, as should be evident from the above description, the present arrangement permits full control of the degree or magnitude of force applied by the set screws 70 to the worm 50 and the magnitude of the pressures selectively applied to the worm in the direction of the worm gear. In this manner, suitable adjustment of the set screws compensates for tolerances and wear and provides positive engagement between the worm gear 30*a* and the worm 50. By providing this adjustment, which can be manually regulated, the proper pressures may always be exerted on the worm arrangement 48 to provide positive engagement between the worm and the worm gear with minimal backlash while permitting selection of the actuating forces required to rotate the knurled knobs 62 at a comfortable level.

The diamond faceting platform 10 of the type generally above described normally includes a scale 72 provided with markings 74 which are alignable with a fixed reference line 80 inscribed in the mounting plate 12. Screws 76 fix the scale 72 to the plate 18 for pivoting motion about the hinge pin 22. Clearly, as the knurled set screw 28 is advanced, and the plates 12 and 18 pivot relative to one another, successive markings 74 will advance past the fixed reference line 80 to indicate the relative angular orientation between the two plates. A slot 78 may be provided within the scale 72 for permitting initial adjustment of the scale 72 to assure that the angular markings 74 accurately designate the angular orientations of the plates relative to one another.

While reference has been made in the above description to Teflon washers or sleeves, it is pointed out that any other suitable material may be substituted therefor which exhibits low frictional properties. Other synthetic resin polymers may similary be utilized. For example, Nylon sleeves may be utilized in place of the Teflon sleeves 56.

The use of two set screws as above described is for illustrative purposes only. While the embodiment shown and described is a presently preferred embodiment, it is also contemplated that other bearing arrangements may be utilized for bearing against the shaft portions 52. An important feature of the present invention is the provision of means for applying selective pressures on the shaft portions 52 without inhibiting free rotation of the worm 50 about its axis. In this manner, the worm 50 can be continuously advanced in the direction of the worm gear 30*a* without being otherwise inhibited in its normal function of actuating the rotation of the worm gear 30*a*.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. An adjustable diamond faceting platform adapted to be mounted on a tong and suitable for supporting a dop, said platform comprising first and second plate members, hinge means connecting adjacent ends of said first and second plate members together to permit said plate members to pivot relative to each other about said hinge means, an opposite end of said first plate member being provided with mounting means for connection to the tong, an arcuate projecting tongue extending from one side of said second plate member at said adjacent end of said second plate member towards one side of said first plate member, spring means for biasing said second plate member about said hinge means to position a free end of said tongue adjacent to said one side of said first plate member, abutment means provided on said first plate member for engaging said tongue to move said free end of said tongue away from said one side of said first plate member to cause said second plate member to pivot about said hinge means to a desired angular orientation with respect to said first plate member, said second plate member being provided with a first opening extending from said one side of said second plate member to an opposite side of said second plate member, a dop receiving socket member having an axis of rotation being disposed in said first opening with a portion of said socket member extending outwardly from said opposite side of said second plate member to receive the dop, said socket member including means for connecting the dop thereto for common rotation about said axis, a worm gear provided on said socket member and within said first opening for rotation about said axis, a second opening extending through said second plate member in communication with said first opening and in a transverse direction to said first opening, a worm rotatably mounted in said second opening proximate to said worm gear for meshingly engaging said worm gear and rotating the same with corresponding rotation of said worm, said worm being mounted with clearance for limited transverse movements in directions towards and away from said worm gear, adjustable bearing means mounted on the platform for engaging said worm and applying selective pressures to said worm in the direction of said worm gear, where suitable adjustment of said bearing means compensates for tolerances and wear and provides positive engagement between said worm gear and said worm, said worm having a central threaded portion meshingly engageable with said worm gear and having cylindrical shaft portions extending axially from each end of said threaded portion, each shaft portion being at least partially disposed within said second plate member, said bearing means cooperating with said shaft portions disposed within said second plate member, said shaft portions extending outwardly beyond said second plate member to be accessible for manual rotation of said worm, sleeve means being provided on each of said shaft portions disposed within said second plate member, said sleeve means including a cylindrical sleeve enclosing each shaft portion disposed within said second plate member, said sleeves being provided with smooth surfaces for minimizing friction between said sleeves and said shaft portions which are rotatably journalled through said sleeves, said bearing means including two set screws threadedly mounted on said second plate member, one of set screws being positioned on each side of said thread portion of said worm for engagement with an associated one of said sleeves, each of said set screws being mounted for advancement in direction of said worm gear and substantially normal to direction of said axis of rotation of said worm gear.

2. A platform as claimed in claim 1, wherein said sleeves are formed of an elastomeric material.

3. A platform as claimed in claim 2, wherein said sleeves are made of Teflon.

* * * * *